US011848154B2

(12) United States Patent
Billard et al.

(10) Patent No.: US 11,848,154 B2
(45) Date of Patent: Dec. 19, 2023

(54) ENCAPSULATED COMPONENTS OF ELECTROMECHANICAL ACTUATORS FOR ELEVATOR SYSTEMS

(71) Applicant: Otis Elevator Company, Farmington, CT (US)

(72) Inventors: Justin Billard, Amston, CT (US); Brad Guilani, Woodstock Valley, CT (US); Daryl J. Marvin, Atlanta, GA (US); Antonio Martins, Vernon, CT (US); Richard Marchetti, Seymour, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 242 days.

(21) Appl. No.: 16/886,166

(22) Filed: May 28, 2020

(65) Prior Publication Data

US 2021/0375517 A1 Dec. 2, 2021

(51) Int. Cl.

| | |
|---|---|
| ***H01F 7/128*** | (2006.01) |
| ***B66B 5/18*** | (2006.01) |
| ***B66B 5/16*** | (2006.01) |
| ***H01F 7/02*** | (2006.01) |

(52) U.S. Cl.

CPC ..... *H01F 7/128* (2013.01); *B66B 5/16* (2013.01); *B66B 5/18* (2013.01); *H01F 7/02* (2013.01)

(58) Field of Classification Search

CPC . B66B 5/16; B66B 5/18; H01F 7/0221; H01F 7/128

See application file for complete search history.

(56) References Cited

U.S. PATENT DOCUMENTS

| | | | | |
|---|---|---|---|---|
| 2004/0262558 | A1* | 12/2004 | Wilson | H01F 7/06 251/129.15 |
| 2013/0234816 | A1* | 9/2013 | Grunschlag | H01F 7/128 335/278 |
| 2018/0162694 | A1* | 6/2018 | Hu | B66B 5/02 |
| 2018/0222718 | A1* | 8/2018 | Khzouz | B66B 5/18 |
| 2018/0327224 | A1* | 11/2018 | Billard | B66B 5/18 |
| 2018/0354749 | A1* | 12/2018 | Fauconnet | B66B 5/18 |

FOREIGN PATENT DOCUMENTS

| | | |
|---|---|---|
| CN | 2606216 Y | 3/2004 |
| CN | 202646476 U | 1/2013 |
| CN | 202851757 U | 4/2013 |
| CN | 203461656 U | 3/2014 |
| CN | 106458512 A | 2/2017 |
| CN | 109256931 A | 1/2019 |

(Continued)

OTHER PUBLICATIONS

European Search Report for European Application No. 20215798.8, dated Jun. 1, 2021, 9 pages.

(Continued)

*Primary Examiner* — Minh Truong
(74) *Attorney, Agent, or Firm* — CANTOR COLBURN LLP

(57) ABSTRACT

Electromagnetic actuators for an elevator systems and encapsulated components thereof are described. The encapsulated components include an encapsulating body and a component assembly is arranged within the encapsulating body, wherein at least some parts of the component assembly are contained within a material of the encapsulating body.

16 Claims, 11 Drawing Sheets

(56) References Cited

FOREIGN PATENT DOCUMENTS

| | | | | |
|---|---|---|---|---|
| CN | 110686028 | A | 1/2020 | |
| DE | 29606994 | U1 | 8/1997 | |
| WO | 2005119708 | A1 | 12/2005 | |
| WO | 2019048196 | A1 | 3/2019 | |
| WO | WO-2019048196 | A1 * | 3/2019 | ..... F02M 21/0254 |

OTHER PUBLICATIONS

China Office Action for China Application No. 202011394309.5; dated Nov. 9, 2022; 7 pages, No Translation.
Chinese Office Action for Application No. 202011394309.5, dated Apr. 19, 2023, 9 Pages.

* cited by examiner

ENCAPSULATED COMPONENTS OF ELECTROMECHANICAL ACTUATORS FOR ELEVATOR SYSTEMS

BACKGROUND

Embodiments described herein relate to elevator brake assemblies and, more specifically, to elevator brakes with electromagnetic assemblies having permanent magnet assemblies that are configured to engage with electromagnet assembly.

Elevator systems may be configured with an electronic safety actuator as an alternative to the typical, centrifugal governor. In such electronic safety actuators, a bi-stable magnetic actuator is used to engage the safeties, and thus enable stopping of an elevator car. The actuators for such systems must be configured to survive thousands of actuations throughout a product life. Designing an electronic safety actuator that survives these repeated actuations is very challenging. Due to the repeated operations, wear and fatigue may occur to various parts of the electronic safety actuator. For example, an electromagnet assembly of an electronic safety actuator can experience fatigue failures in coils and lead wire connectors associated with the electromagnet. Additionally, the mounting configuration of such components and the resulting wear and environment of such mounted components can lead to shearing of metal flanges or other static components. Accordingly, an improved electronic safety actuator is desirable.

BRIEF SUMMARY

In accordance with some embodiments, encapsulated components of electromechanical assemblies for elevator systems are provided. The encapsulated component includes an encapsulating body and a component assembly is arranged within the encapsulating body, wherein at least some parts of the component assembly are contained within a material of the encapsulating body.

In addition to one or more of the features described above, or as an alternative, further embodiments of the encapsulated components may include that the component assembly is an electromagnet assembly.

In addition to one or more of the features described above, or as an alternative, further embodiments of the encapsulated components may include that the component assembly is a magnet assembly.

In addition to one or more of the features described above, or as an alternative, further embodiments of the encapsulated components may include that the encapsulating body includes a shell defining a cavity, wherein the at least some parts of the component assembly are housed within the cavity.

In addition to one or more of the features described above, or as an alternative, further embodiments of the encapsulated components may include a material surrounding the at least some parts of the component assembly and filling the cavity.

In addition to one or more of the features described above, or as an alternative, further embodiments of the encapsulated components may include that the encapsulating body is formed of a non-magnetic material.

In addition to one or more of the features described above, or as an alternative, further embodiments of the encapsulated components may include that the component assembly includes a ferrite core.

In addition to one or more of the features described above, or as an alternative, further embodiments of the encapsulated components may include that the encapsulating body comprises a main body, a first mounting extension extending from a first end of the main body, and a second mounting extension extending from a second end of the main body.

In addition to one or more of the features described above, or as an alternative, further embodiments of the encapsulated components may include that the encapsulating body comprises a component integrator configured to receive a connecting pin.

According to some embodiments, electromechanical actuators of elevator systems are provided. The electromechanical actuators include a housing assembly, an electromagnet assembly installed within the housing assembly, and a magnet assembly installed within the housing assembly. At least one of the electromagnet assembly and the magnet assembly is an encapsulated component. The encapsulated component includes an encapsulating body and a respective assembly arranged within the encapsulating body, wherein at least some parts of the respective assembly are contained within a material of the encapsulating body.

In addition to one or more of the features described above, or as an alternative, further embodiments of the electromechanical actuators may include that the encapsulating body comprises a main body, a first mounting extension extending from a first end of the main body, and a second mounting extension extending from a second end of the main body.

In addition to one or more of the features described above, or as an alternative, further embodiments of the electromechanical actuators may include that the encapsulating body comprises a component integrator configured to receive a connecting pin.

In addition to one or more of the features described above, or as an alternative, further embodiments of the electromechanical actuators may include that the electromagnet assembly includes a ferrite core.

In addition to one or more of the features described above, or as an alternative, further embodiments of the electromechanical actuators may include that the magnet assembly comprises a permanent magnet and a toothed block.

In addition to one or more of the features described above, or as an alternative, further embodiments of the electromechanical actuators may include that the encapsulating body includes a shell defining a cavity, wherein the at least some parts of the component assembly are housed within the cavity.

In addition to one or more of the features described above, or as an alternative, further embodiments of the electromechanical actuators may include a material surrounding the at least some parts of the component assembly and filling the cavity.

In addition to one or more of the features described above, or as an alternative, further embodiments of the electromechanical actuators may include that the encapsulating body is formed of a non-magnetic material.

In addition to one or more of the features described above, or as an alternative, further embodiments of the electromechanical actuators may include that the encapsulating body is formed of plastic.

In addition to one or more of the features described above, or as an alternative, further embodiments of the electromechanical actuators may include a connecting rod and a safety brake. The magnet assembly is operably coupled to the safety brake by the connecting rod.

In addition to one or more of the features described above, or as an alternative, further embodiments of the electromechanical actuators may include that the housing assembly comprises a first housing configured to be attached to a portion of an elevator car and a second housing defining a track, with the magnet assembly configured to move along the track.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION

Figure 1:
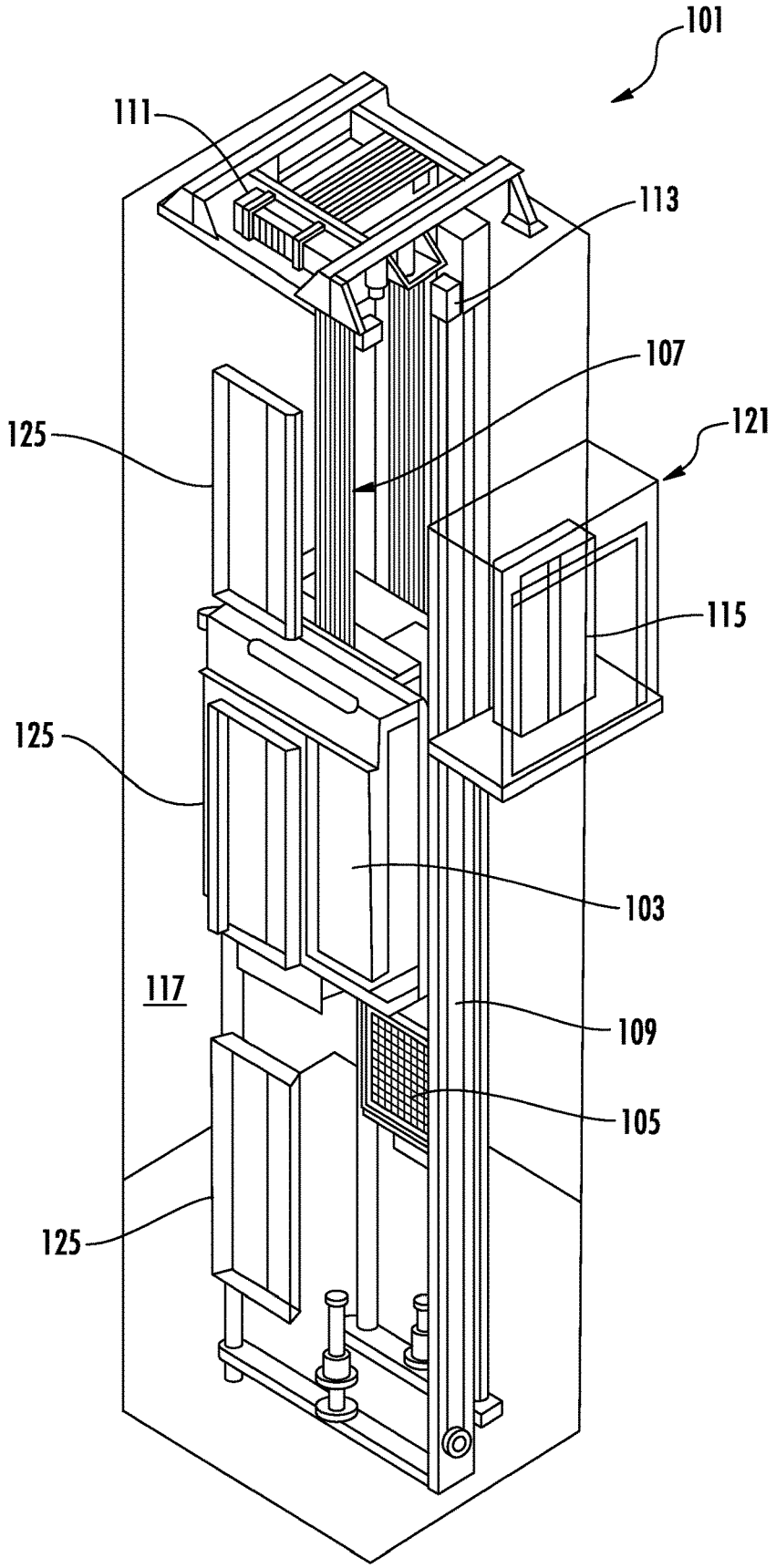
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter-weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
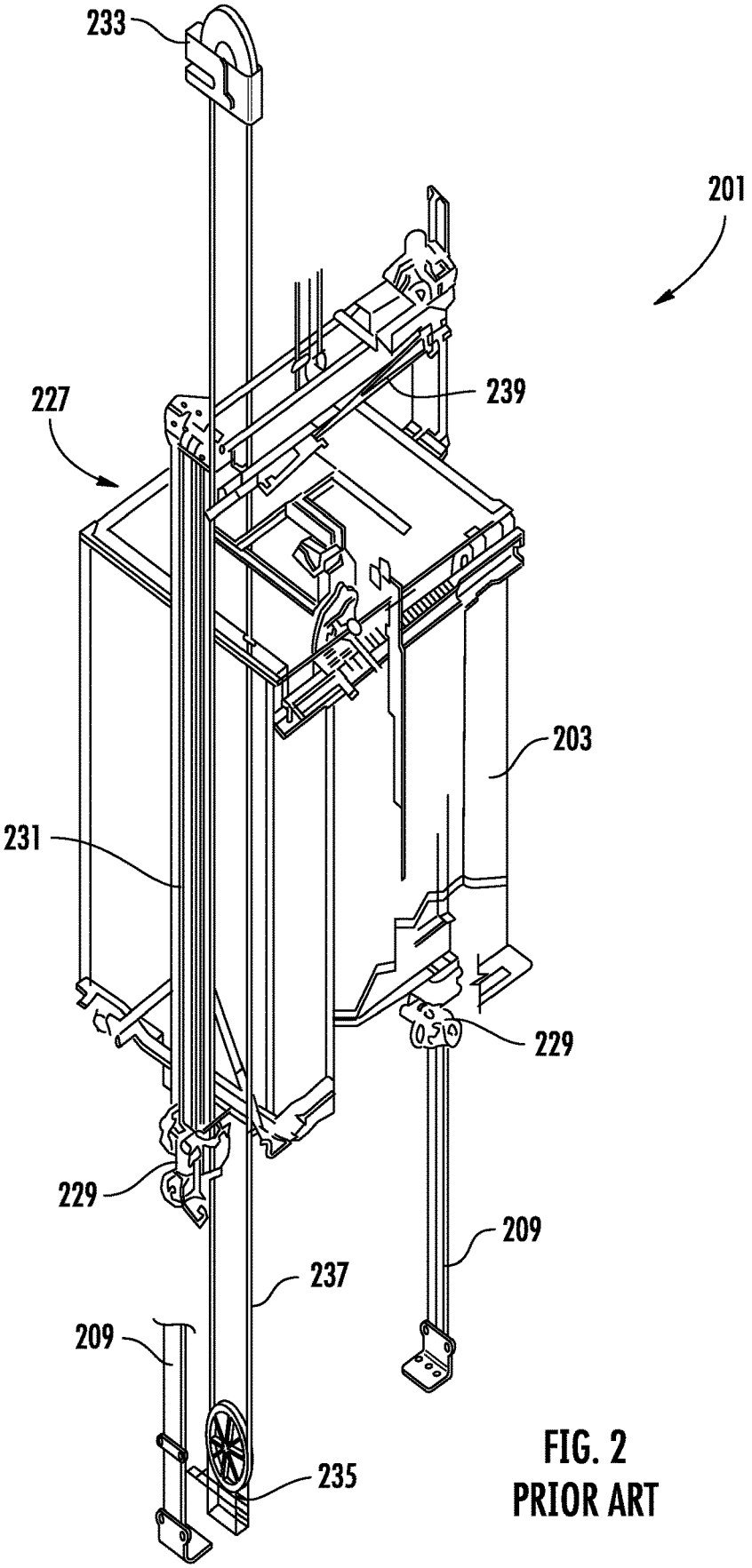
FIG. 2 PRIOR ART
FIG. 2 is a prior art arrangement of an overspeed safety system for elevators.

Turning to FIG. 2, a schematic illustration of a prior elevator car overspeed safety system 227 of an elevator system 201 is shown. The elevator system 201 includes an elevator car 203 that is movable within an elevator shaft along guide rails 209. In this illustrative embodiment, the overspeed safety system 227 includes a pair of braking elements 229 that are engageable with the guide rails 209. The braking elements 229 are actuated, in part, by operation of lift rods 231. The triggering of the braking elements 229 is achieved through a governor 233, typically located at the top of the elevator shaft, which includes a tension device 235 located within the pit of the elevator shaft with a cable 237 operably connecting the governor 233 and the tension device 235. When an overspeed event is detected by the governor, the overspeed safety system 227 is triggered, and a linkage 239 is operated to actuate a combination of lift rods 231 simultaneously to cause actuation (e.g., self-engagement) of the braking elements 229 (e.g., safety wedges) that engage with the guide rail and cause a smooth and even stopping or braking force to stop the travel of the elevator car. As used herein the term "overspeed event" refers to an event during which a speed, velocity, or acceleration of an elevator car exceeds a predetermined threshold of the respective state of motion, and is not intended to be limited to constant speed, but rather also includes rates of change (e.g., acceleration) and also direction of travel of motion the elevator car (e.g., velocity). The linkage 239, as shown, is located on the top of the elevator car 203 and ensures simultaneous operation of the braking elements 229. However, in other configurations, the linkage may be located below a platform (or bottom) of the elevator car. As shown, various components are located above and/or below the elevator car 203, and thus pit space and overhead space within the elevator shaft must be provided to permit operation of the elevator system 201.

Figure 3A:
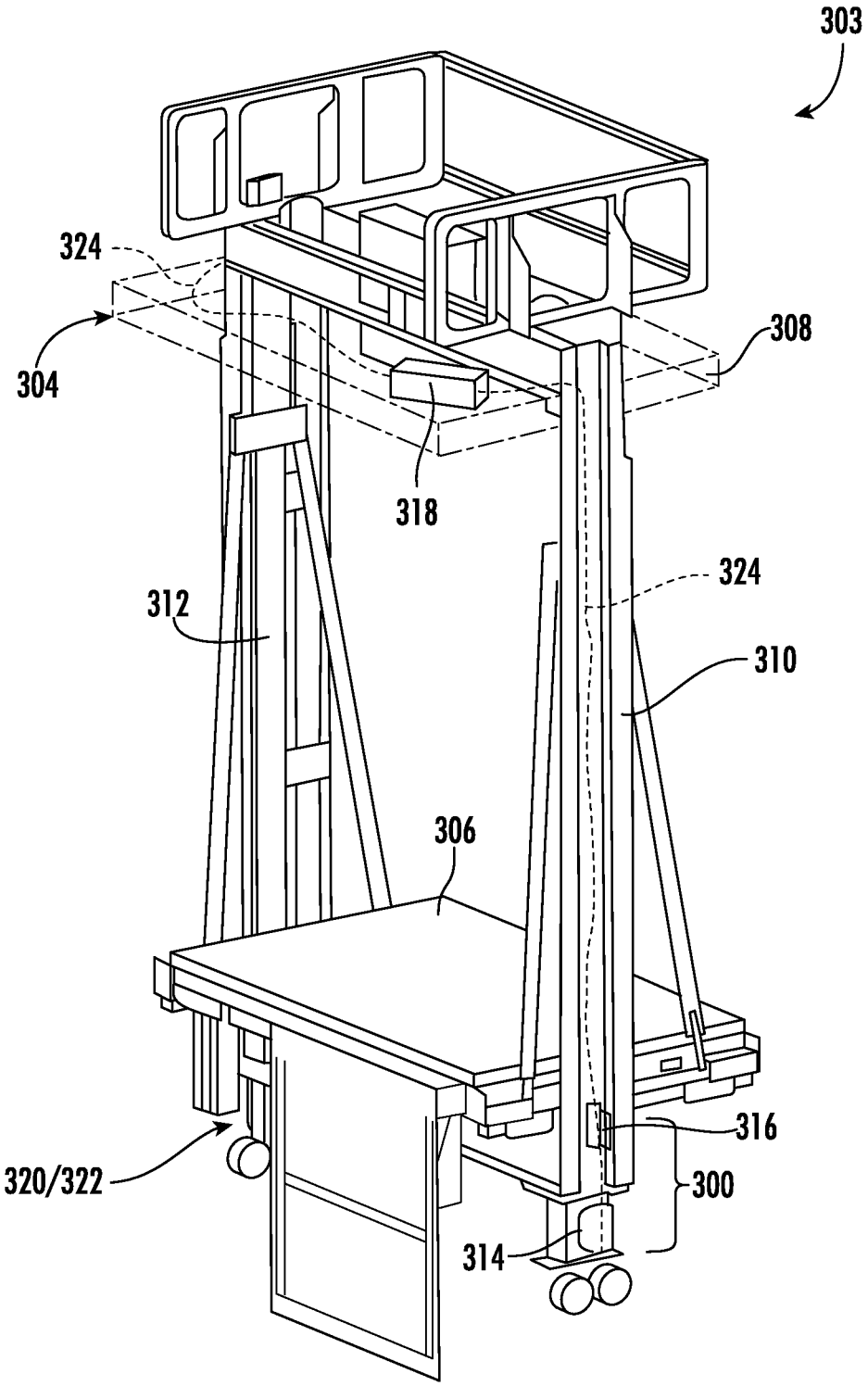
FIG. 3A is an isometric illustration of an elevator car frame having an overspeed safety system in accordance with an embodiment of the present disclosure.
Figure 3B:
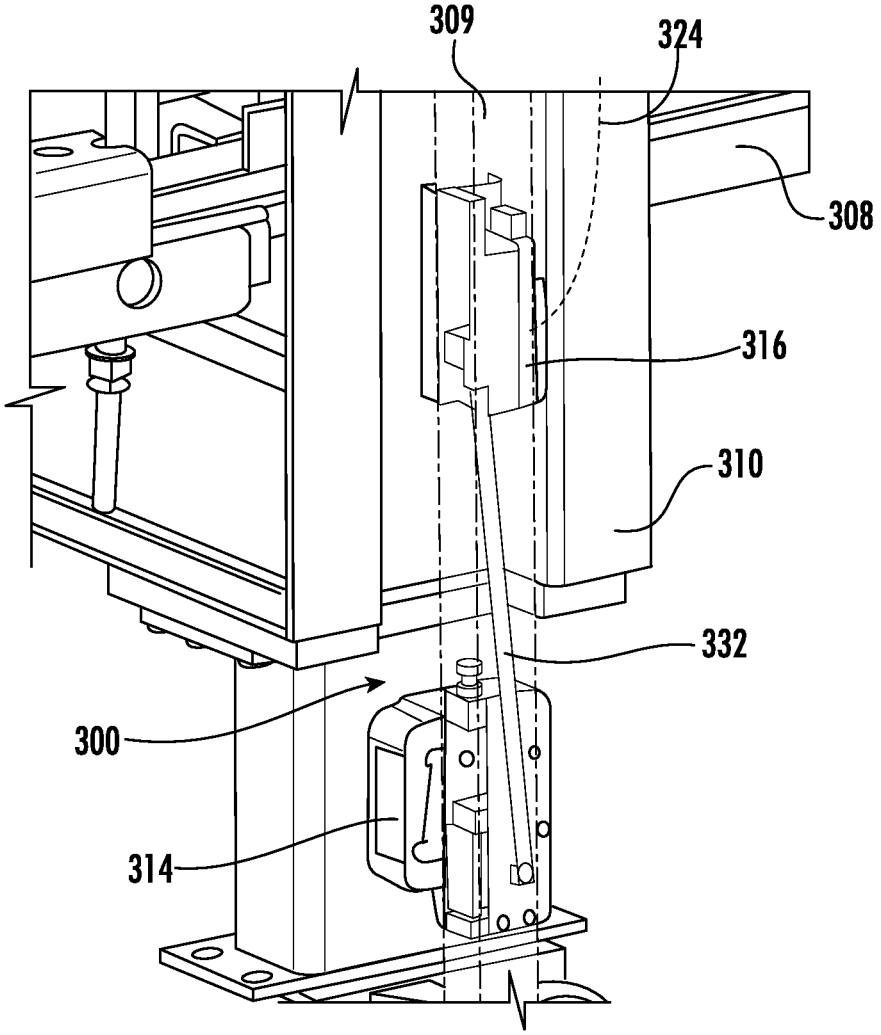
FIG. 3B is an enlarged illustrative view of a portion of the overspeed safety system of FIG. 3A.
Figure 3C:
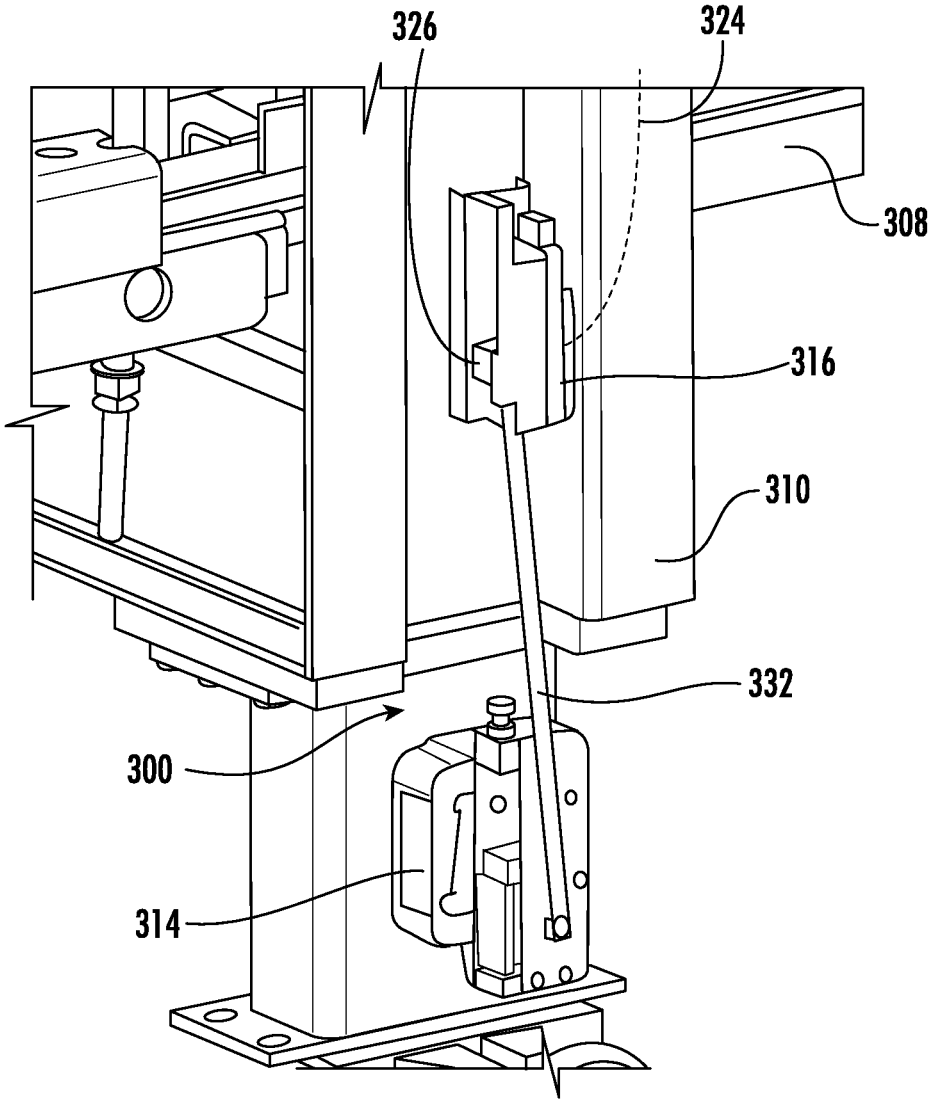
FIG. 3C is the same view as FIG. 3B, but with a guide rail removed for clarity.

Turning now to FIGS. 3A-3C, schematic illustrations of an elevator car 303 having an overspeed safety system 300 in accordance with an embodiment of the present disclosure are shown. FIG. 3A is an isometric illustration of an elevator car frame 304 with the overspeed safety system 300 installed thereto. FIG. 3B is an enlarged illustration of a portion of the overspeed safety system 300 showing a relationship with a guide rail. FIG. 3C is a schematic similar to FIG. 3B, but with the guide rail removed for clarity of illustration.

The car frame 304 includes a platform 306, a ceiling 308, a first car structural member 310, and a second car structural member 312. The car frame 304 defines a frame for supporting various panels and other components that define the elevator car for passenger or other use (i.e., define a cab of the elevator), although such panels and other components are omitted for clarity of illustration. The elevator car 303 is moveable along guide rails 309 (shown in FIG. 3B), similar to that shown and described above. The overspeed safety system 300 provides a safety braking system that can stop the travel of the elevator car 303 during an overspeed event.

The overspeed safety system 300 includes a first safety brake 314, a first electromechanical actuator 316, and a controller or control system 318 operably connected to the first electromechanical actuator 316. The first safety brake 314 and the first electromechanical actuator 316 are arranged along the first car structural member 310. A second safety brake 320 and a second electromechanical actuator 322 are arranged along the second car structural member 312. The control system 318 is also operably connected to the second electromechanical actuator 322. The connection between the control system 318 and the electromechanical actuators 316, 322 may be provided by a communication line 324. The communication line 324 may be wired or wireless, or a combination thereof (e.g., for redundancy). The communication line 324 may be an electrical wire to supply electrical power from the control system 318 and an electromagnet of the first electromechanical actuator 316. It will be appreciated that in alternative configurations, the communication may be a wireless communication system, both for data/information and/or wireless power transfer.

As shown, the control system 318 is located on the top or ceiling 308 of the car frame 304. However, such position is not to be limiting, and the control system 318 may be located anywhere within the elevator system (e.g., on or in the elevator car, within a controller room, etc.). The control system 318 may comprise electronics and printed circuit boards for processing (e.g., processor, memory, communication elements, electrical buss, etc.). Thus, the control system 318 may have a very low profile and may be installed within ceiling panels, wall panels, or even within a car operating panel of the elevator car 303. In other configurations, the control system 318 may be integrated into various of the components of the overspeed safety system 300 (e.g., within or part of the electromechanical actuator 316).

The overspeed safety system 300 is an electromechanical system that eliminates the need for a linkage or linking element installed at the top or bottom of the elevator car. The control system 318 may include, for example, a printed circuit board with multiple inputs and outputs. In some embodiments, the control system 318 may include circuitry for a system for control, protection, and/or monitoring based on one or more programmable electronic devices (e.g., power supplies, sensors, and other input devices, data highways and other communication paths, and actuators and other output devices, etc.). The control system 318 may further include various components to enable control in the event of a power outage (e.g., capacitor/battery, etc.). The control system 318 may also include an accelerometer or other component/device to determine a speed of an elevator car (e.g., optical sensors, laser range finders, etc.). In such embodiments, the control system 318 is mounted to the elevator car, as shown in the illustrative embodiments herein.

The control system 318, in some embodiments, may be connected to and/or in communication with a car positioning system, an accelerometer mounted to the car (i.e., a second or separate accelerometer), and/or to the elevator controller. Accordingly, the control system 318 may obtain movement information (e.g., speed, direction, acceleration) related to movement of the elevator car along an elevator shaft. The control system 318 may operate independently of other systems, other than potentially receiving movement information, to provide a safety feature to prevent overspeed events.

The control system 318 may process the movement information provided by a car positioning system to determine if an elevator car is traveling at a speed in excess of a threshold speed. If the threshold is exceeded, the control system 318 will trigger the electromechanical actuators and the safety brakes. The control system 318 will also provide feedback to the elevator control system about the status of the overspeed safety system 300 (e.g., normal operational position/triggered position). It will be appreciated that although referred to as an "overspeed" system, the systems may be configured to determine if an elevator car is accelerating at a rate in excess of a threshold acceleration, and the term "overspeed" is not to be limiting to merely a constant rate of motion.

Thus, the overspeed safety system 300 of the present disclosure enables electrical and electromechanical safety braking in the event of overspeed events. The electrical aspects of the present disclosure enable the elimination of the physical/mechanical linkages that have traditionally been employed in overspeed safety systems. That is, the electrical connections allow for simultaneous triggering of two separate safety brakes through electrical signals, rather than relying upon mechanical connections and other components such as wheels, ropes, etc.

With reference to FIG. 3C, details of parts of the overspeed safety system 300 are shown. The first electromechanical actuator 316 is mounted to the first car structural member 310 using one or more fasteners. The first electromechanical actuator 316 includes a magnet assembly 326 that is configured to magnetically engage with the guide rail 309. The first electromechanical actuator 316 is operably connected to the control system 318 by the communication line 324. The control system 318 can transmit an actuation signal to the first electromechanical actuator 316 (and the second electromechanical actuator 322) to perform an actuation operation when an overspeed event is detected. As used herein the term "overspeed event" refers to an event during which a speed, velocity, or acceleration of an elevator car exceeds a predetermined threshold of the respective state of motion, and is not intended to be limited to constant speed, but rather also includes rates of change (e.g., acceleration) and also direction of travel of motion the elevator car (e.g., velocity). The first electromechanical actuator 316 will actuate a connecting rod 332, by means of the magnet assembly 326 that is operably connected to the first safety brake 314. When the connecting rod 332 is actuated, the first safety brake 314 will actuate to engage with the guide rail 309, e.g., using a safety brake element 334, such as a safety roller or wedge. In some embodiments, the two-part illustrated configuration may be integrated into a single unit, thus potentially eliminating the connecting rod.

In accordance with embodiments of the present disclosure, portions of the overspeed safety system are bolted or other attachment means are used to fix the components to the upright. That is, the overspeed safety system in accordance with some embodiments of the present disclosure does not float within the upright, and it is not guided by the rail. For example, in normal operation, the overspeed safety system has no contact with the guide rail. Therefore, as the elevator car floats in the front-to-back direction, the components of the overspeed safety system (e.g., a housing) move with the elevator car and the magnet assembly is sometimes closer to the blade of the guide rail and sometimes farther from the guide rail. One advantage of such approach, in accordance with embodiments of the present disclosure, is that guiding elements are not needed, and therefore, the risk of noise from the guiding elements rubbing along the rail is eliminated. Similarly, for example, there is no risk of these guiding elements wearing because they are not included in the design. However, because the magnet assembly floats with the elevator car, and thus may be relatively far from the guide rail, triggering of the system (e.g., moving the magnet assembly from an electromagnet assembly of the system to engage with the guide rail) may be more difficult. Further, such configuration may increase the difficulty of resetting the system after activation (e.g., removing the magnet assembly from the guide rail and returning it to the electromagnet assembly).

Figure 5B:
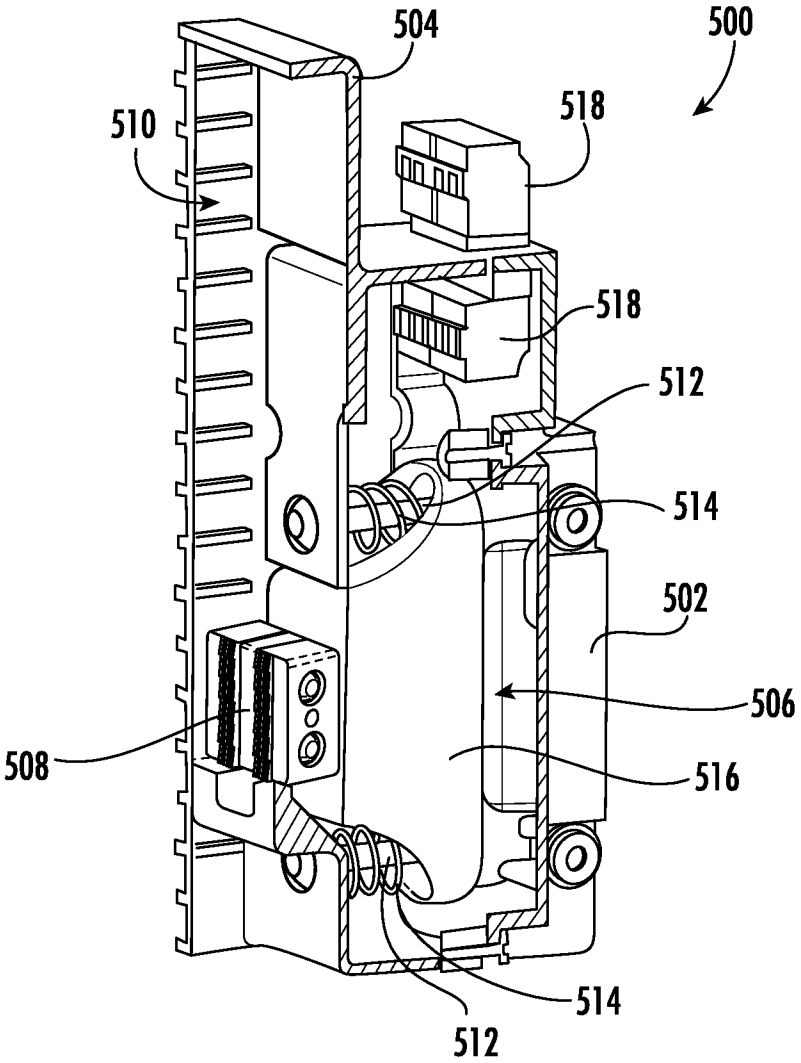
FIG. 5B is a partial cross-sectional illustration of the electromechanical actuator of FIG. 5A.
Figure 5A:
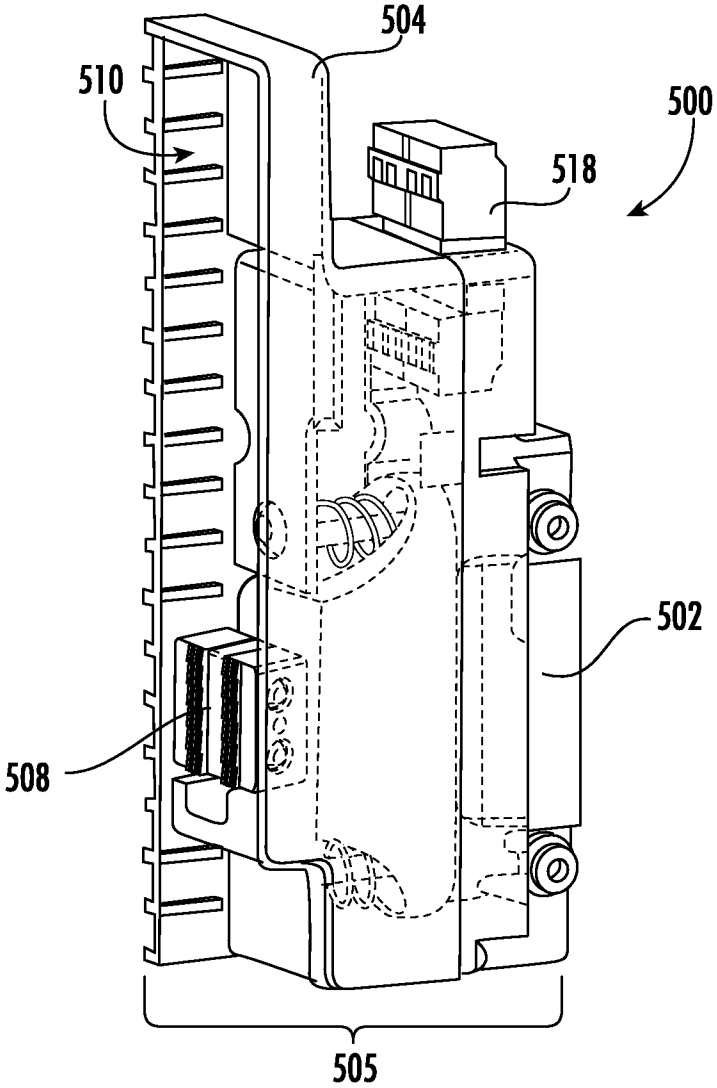
FIG. 5A is a schematic illustration of an electromechanical actuator in accordance with an embodiment of the present disclosure.

To overcome these considerations, as described herein and in accordance with some embodiments of the present disclosure, biasing element (e.g., springs) are included in the overspeed safety system. One end of the biasing element is fixed against a housing of the overspeed safety system and the other end acts to push the electromagnet assembly into the housing. During resetting, the electromagnet assembly overcomes the force of the biasing elements, moves toward the guide rail and the magnet assembly that is magnetically engaged to the guide rail. When the electromagnet assembly contacts the back surface of the magnet assembly or becomes imminently close to it, the magnet assembly releases from the guide rail and magnetically engages with the electromagnet assembly (e.g., the magnetic force applied by the electromagnetic assembly overcomes the magnetic attraction between the magnet assembly and the guide rail). The biasing elements then act to move the electromagnet assembly and the magnet assembly back into the housing. Such configurations may be subject to repeated forces, actuations, and vibrations, and thus components thereof may suffer from fatigue and part failure. However, embodiments of the present disclosure overcome these issues, and provide additional advantages, as described below, through the introduction of a more robust surface of the electromagnet assembly for the springs to push against (e.g., as shown in FIGS. 5A-5B). Further, embodiments of the present disclosure may also be employed with fixed electromagnetic assemblies (e.g., without such springs).

Figure 4:
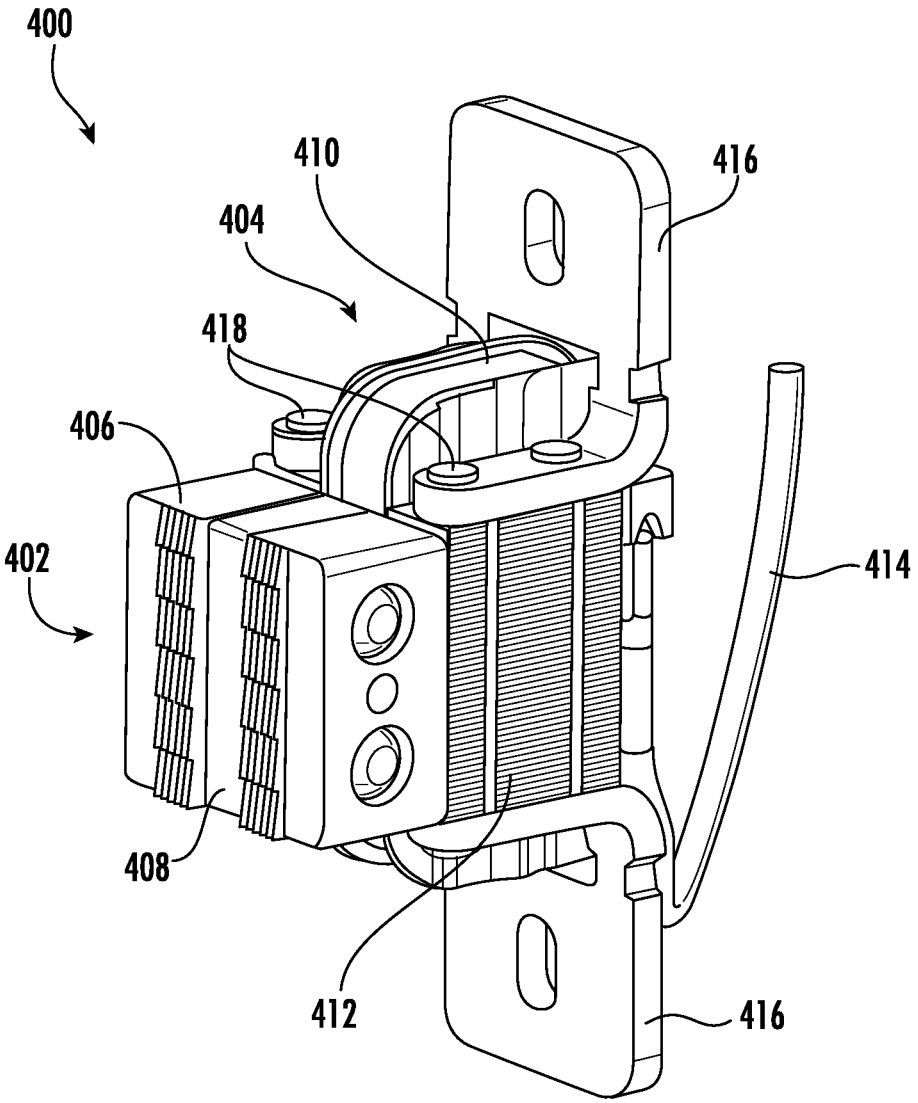
FIG. 4 PRIOR ART
FIG. 4 is a schematic illustration of a portion of an electromagnet actuator in accordance with prior configurations.

Turning now to FIG. 4, a schematic illustration of an electromagnet actuator 400 of a prior configuration is shown. The electromagnet actuator 400 may be a part of an electromechanical actuator, as shown and described above. The electromagnet actuator 400, as illustratively shown in this example embodiment, includes a magnet assembly 402 that is operably (and magnetically) connectable to an electromagnet assembly 404. The magnet assembly 402 includes an optional toothed block 406 and a magnet 408 (e.g., permanent magnet), and may be connected to a connecting rod (not shown), as will be appreciated by those of skill in the art, or directly connected to a safety brake in a single unit.

In this illustrative non-limiting configuration, the electromagnet assembly 404 includes a coil 410 arranged around a core 412 (e.g., formed from steel or steel plates). One or more lead wires 414 are electrically connected to the coil 410 to supply electricity thereto and thus generate a magnetic field by means of the coil 410 and the core 412. The coil 410 and the core 412 are located within a housing or other part of an elevator car (e.g., a frame) and movably mounted thereto (e.g., along springs or other biasing elements). The magnet 408 of the magnet assembly 402 is releasable from the electromagnet assembly 404 during a braking operating and thus cause a connecting rod to engage a safety brake of an elevator car. It will be appreciated that other configurations of electromagnetic assemblies may be employed without departing from the scope of the present disclosure.

As shown, the coil 410 and the core 412 are mounted to a flange support 416 by one or more fasteners 418 (e.g., bolts). The biasing elements are configured to apply a biasing force against the flange support 416, as will be appreciated by those of skill in the art. During a lifetime operation of the electromagnet actuator 400, the environment and forces generated during operation may cause wear and/or fatigue. For example, the fasteners 418 that pass through the core 412 may flex or bend. Further, curved portions of the flange support 416 can be subject to forces that can cause material fatigue (e.g., cracking). Further, the lead wire 414 may be subject to movement and thus the wire itself and/or electrical connectors and connections may suffer from similar fatigue and wear.

Embodiments of the present disclosure are directed to electromagnet assembly designs and electromagnet actuators that are able to survive thousands of actuations that are experienced over the product life and overcome the failure modes described above, in addition to providing other benefits and features, as described herein. In some embodiments of the present disclosure, the electromagnet assembly is encapsulated in plastic through an insert injection molding process. In another embodiment, the electromagnet assembly is placed inside a plastic shell and potted in place using an epoxy or similar substance.

Turning now to FIGS. 5A-5B, schematic illustrations of an electromechanical actuator 500 in accordance with an embodiment of the present disclosure are shown. FIG. 5A illustrates an isometric illustration of the electromechanical actuator 500 and FIG. 5B is a partial cross-sectional view of the electromechanical actuator 500.

The electromechanical actuator 500 includes a first housing 502 and a second housing 504 that are fixedly connected together. Although shown, two separate housing components 502, 504 are configured to form a housing assembly 505. In alternative embodiments, the housing assembly 505 may be a single body, structure, or component that has substantially the same shape, structure, and configuration as the illustrative first and second housings 502, 504. The electromechanical actuator 500 further includes an electromagnet assembly 506 and a magnet assembly 508. As shown in FIG. 5B, the electromagnet assembly 506 may be housed between the first housing 502 and the second housing 504 and the magnet assembly 508 is housed within a track 510 defined by the second housing 504. In operation, the magnet assembly 508 may move along and within the track 510.

The electromagnet assembly 506 is a preformed structure that includes a coil and a core (e.g., laminated core, machined piece(s), etc.). Although shown and described as a laminated core, other core structures are possible without departing from the scope of the present disclosure. For example, in some embodiments, the core may be steel cores (e.g., formed from machined pieces) or ferrite cores. Advantageously, because the preformed structure is a unitary structure, the electromagnet assembly 506 does not include flanges and/or fasteners (two of the prior configurations failure points). The electromagnet assembly 506 may be moveably mounted within the housing 502, 504 along one or more guides 512 and be biased to a rest position by one or more biasing elements 514 along the guides 512. Additionally, lead wires electrically connected to the coil of the electromagnet assembly 506 may be securely retained or installed within the unitary structure. The electromagnet assembly 506 includes an encapsulating body 516 which contains the components of the electromagnet assembly 506. The encapsulating body 516 may be, for example, a preformed body, a cast body, a molded structure, or a potted structure that has the components of the electromagnet assembly 506 embedded therein (e.g., coil, laminated core, lead wire, etc.). In some embodiments, the encapsulating body 516 may be preformed and the components installed therein and in other embodiments, the encapsulating body 516 may be formed around the components. The lead wire may electrically connect to an electrical connector 518. The electrical connector 518 may be fixedly attached to or mounted to the first housing 502 and can provide for electrical connection between the electromagnet assembly 506 and an electrical source of control system (e.g., as shown and described above).

The first housing 502 is configured to be mounted to or affixed to a portion of an elevator car, such as a frame. The second housing 504 is configured to be a portion of the structure that is moveable along (e.g., adjacent or relative to) a guide rail of an elevator system. That is, the second housing 504 defines a portion of the electromechanical actuator 500 that is adjacent to or proximate the guide rail. This results in the magnet assembly 508 being arranged and retained within the track 510 of the second housing 504 between material of the first and/or second housing 502, 504 and the guide rail. It will be appreciated that the second housing 504 preferably does not contact the guide rail. That is, although the elevator car and electromechanical actuator 500 may float away from the guide rail (e.g., relative movement/motion), the dimensions of the magnet assembly 508 are such that the magnet assembly 508 never leaves the track 510.

As shown in FIGS. 5A-5B, the electromagnet assembly 506 is an encapsulated component of the electromechanical actuator 500. However, as described herein, other components, such as the magnet assembly 508 may be alternatively or additionally encapsulated.

Figure 6:
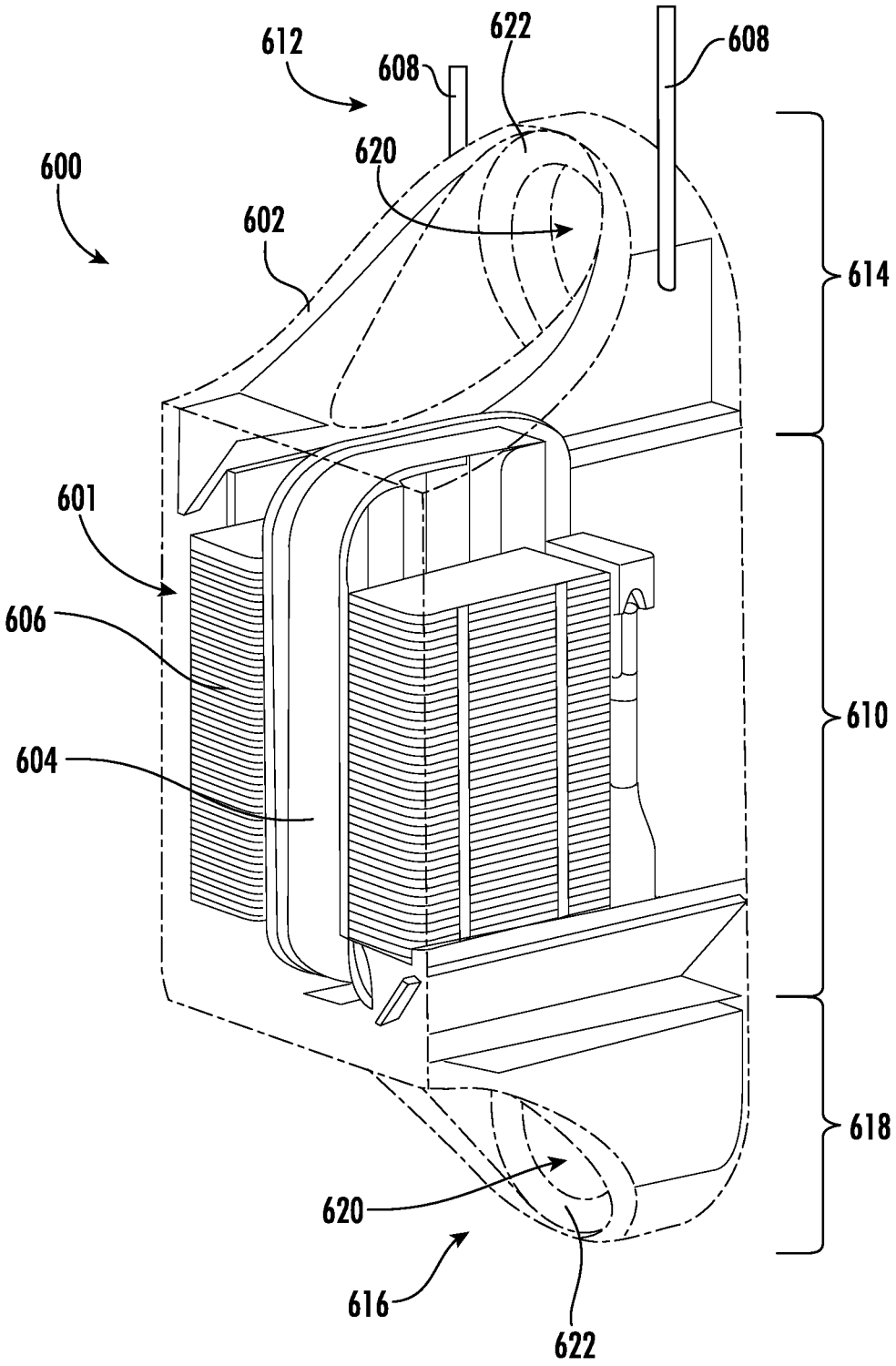
FIG. 6 is a schematic illustration of an encapsulated electromagnet assembly in accordance with an embodiment of the present disclosure.

Turning now to FIG. 6, a schematic illustration of an encapsulated electromagnet assembly 600 in accordance with an embodiment of the present disclosure is shown. The encapsulated electromagnet assembly 600 may be used in an electromechanical actuator, as shown and described above. The encapsulated electromagnet assembly 600 includes an encapsulating body 602 that contains components of an electromagnet assembly 601. As shown, the electromagnet assembly 601 includes, at least, a coil 604 and a core 606 which are configured to generate a magnetic field. The coil 604 is electrically connected to lead wires 608 which can electrically connect to a power source and/or controller system, such as shown and described above. The encapsulating body 602 can entirely encapsulate at least the coil 604, the core 606, and at least a portion of the lead wires 608. In such embodiments, when a magnet is adjacent to the coil 604 and the core 606, there is no direct material contact between the magnet assembly and the core 606. In other embodiments, the facing of the core 606 may be exposed such that direct material contact with a magnet assembly is possible. As noted, the lead wires 608 are at least partially housed within the encapsulating body 602 such that the lead wires 608 are protected at the connection point with the coil 604.

The encapsulating body 602 has a main body 610 that comprises material that surrounds and contains at least the coil 604 and the core 606. At a first end 612 of the encapsulating body 602 and extending from the main body 610 is a first mounting extension 614. At a second end 616 of the encapsulating body 602 and extending from the main body 610 is a second mounting extension 618. Each of the first mounting extension 614 and the second mounting extension 618 define a respective mounting aperture 620 which is, in part, defined by a respective biasing surface 622. When installed within an electromechanical actuator, a guide can pass through the respective mounting apertures 620 and a biasing element can be arranged about the guides and contact the biasing surfaces 622.

In some non-limiting embodiments, the encapsulating body 602 may be formed from any desirable material. However, it is preferable that the selected material is non-magnetic so as to not interfere with operation of the electromagnet-magnet configuration of the electromechanical actuator. For example, a plastic, non-magnetic metal, nylon, polyester, polycarbonates (e.g., Polycarbonate/Acrylonitrile Butadiene Styrene), etc. may be used. The aforementioned materials are merely exemplary and the choice of material is not limited except for the requirement of being non-magnetic. The material may be formed by casting or molding, with the internal components positioned during the manufacturing process. One form of manufacture may be by injection molding.

Figure 7:
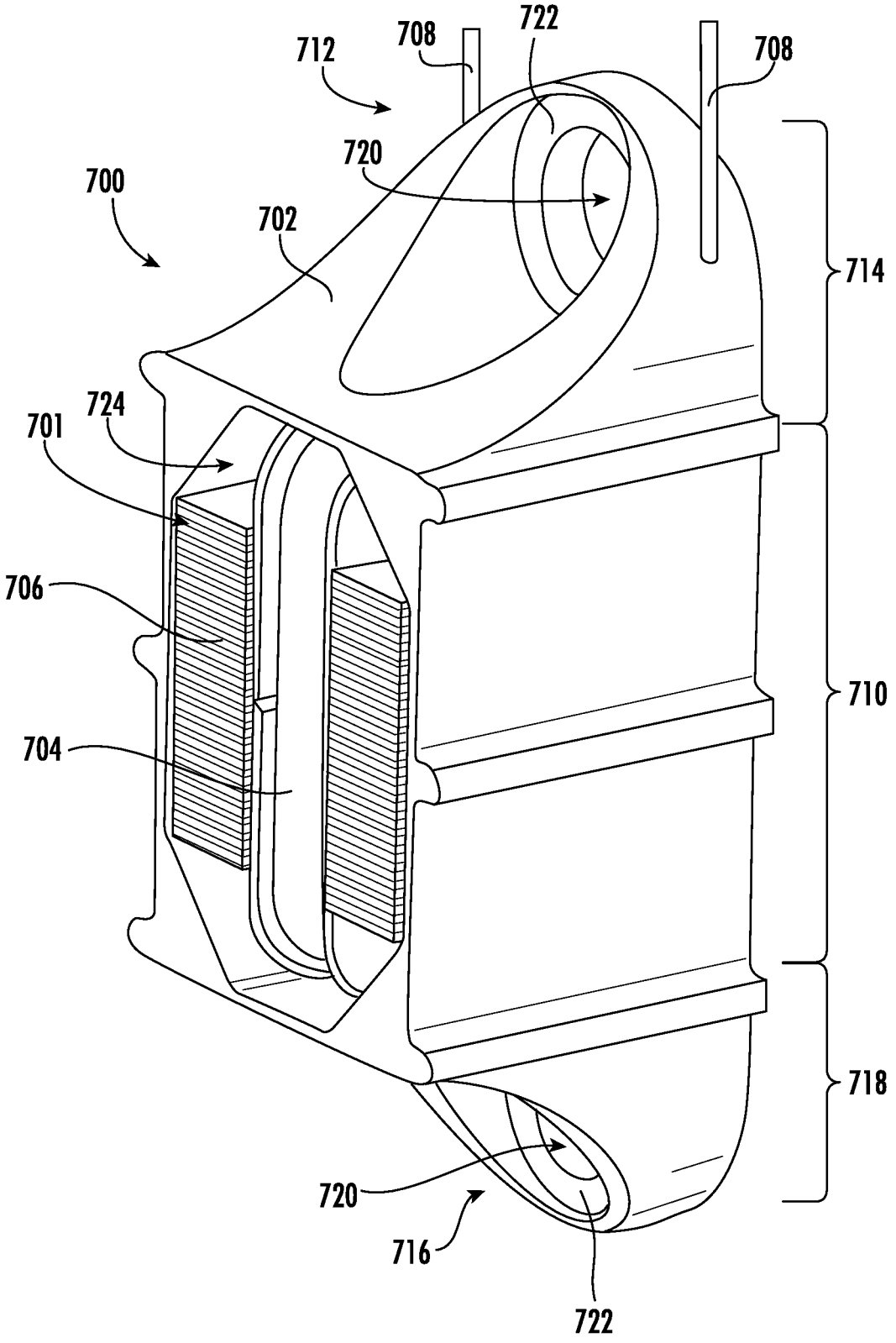
FIG. 7 is a schematic illustration of an encapsulated electromagnet assembly in accordance with an embodiment of the present disclosure.

Turning now to FIG. 7, a schematic illustration of an encapsulated electromagnet assembly 700 in accordance with an embodiment of the present disclosure is shown. The encapsulated electromagnet assembly 700 may be used in an electromechanical actuator, as shown and described above. The encapsulated electromagnet assembly 700 includes an encapsulating body 702 that contains components of an electromagnet assembly 701. As shown, the electromagnet assembly 701 includes a coil 704 and a core 706 which are configured to generate a magnetic field. The coil 704 is electrically connected to lead wires 708 which can electrically connect to a power source and/or controller system, such as shown and described above. The encapsulating body 702 can entirely encapsulate at least the coil 704, the core 706, and at least a portion of the lead wires 708. In such embodiments, when a magnet is adjacent to the coil 704 and the core 706, there may be direct material contact between the magnet assembly and the core 706. In other embodiments, the facing of the core 706 may be covered by a non-magnetic encapsulating resin such that direct material contact with a magnet assembly is prevented. As noted, the lead wires 708 are at least partially housed within the encapsulating body 702 such that the lead wires 708 are protected at the connection point with the coil 704.

The encapsulating body 702 has a main body 710 that comprises material that surrounds and contains at least the coil 704 and the core 706. At a first end 712 of the encapsulating body 702 and extending from the main body 710 is a first mounting extension 714. At a second end 716 of the encapsulating body 702 and extending from the main body 710 is a second mounting extension 718. Each of the first mounting extension 714 and the second mounting extension 718 define a respective mounting aperture 720 which is, in part, defined by a respective biasing surface 722. When installed within an electromechanical actuator, a guide can pass through the respective mounting apertures 720 and a biasing element can be arranged about the guides and contact the biasing surfaces 722.

In some non-limiting embodiments, the encapsulating body 702 may be formed from any desirable material. However, it is preferable that the selected material is non-magnetic so as to not interfere with operation of the electromagnet-magnet configuration of the electromechanical actuator. In the configuration shown in FIG. 7, the encapsulating body 702 may be formed as a shell with a cavity 724 defined therein. The components of the electromagnet (e.g., coil 704 and core 706) may be arranged within the cavity 724 and a non-magnetic encapsulating resin or other filler material may be injected to fill the remaining space of the cavity 724. As such, the electromagnetic assembly 701 may be suspended and fixedly retained within the encapsulating body 702. The main portion (or shell) of the encapsulating body 702 may be formed of any desirable materials (e.g., those described above) and any desirable non-magnetic encapsulating resin may be used, such as, epoxy, acrylic, polyurethane, or other thermosetting resin.

The above described encapsulated electromagnet assemblies, shown as examples in FIGS. 6-7, may be implemented within the electromechanical actuator configuration shown in FIG. 5, or in other electromechanical actuator systems and configurations. That is, the illustrative drawings and descriptions thereof are merely for example and explanatory purposes, and the specific combination of features is not to be limiting, but rather to inform one of skill in the art of some potential configurations. To be explicit, the electromechanical actuator shown in FIG. 5 can incorporate encapsulated electromagnet assemblies shown in FIGS. 6-7. Further, various other electromechanical actuator configurations and arrangements can incorporate the described encapsulated electromagnet assemblies and like structures in accordance with the present disclosure.

Figure 8:
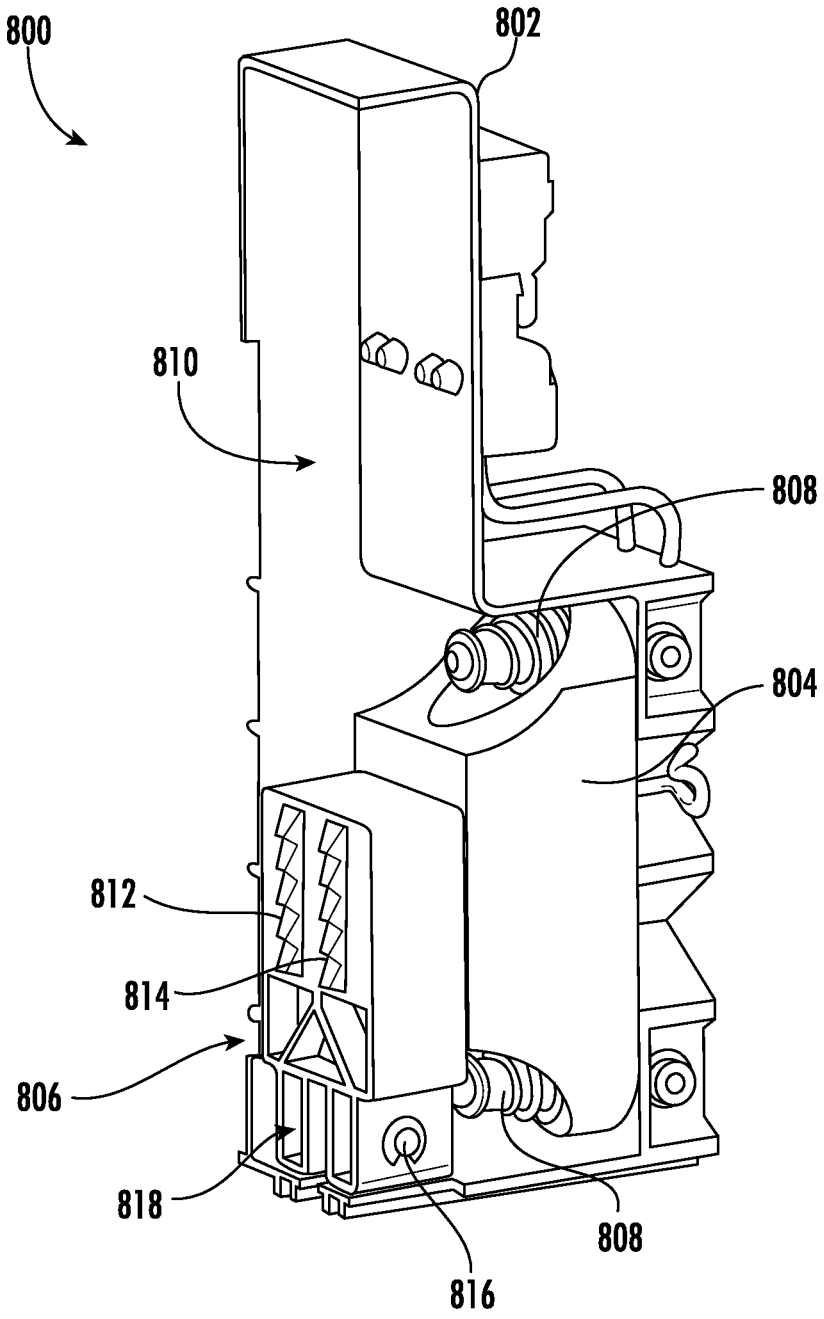
FIG. 8 is a schematic illustration of an electromechanical actuator in accordance with an embodiment of the present disclosure.

Turning now to FIG. 8, a schematic illustration an electromechanical actuator 800 in accordance with an embodiment of the present disclosure is shown. The electromechanical actuator 800, as shown, includes a unitary formed housing 802 similar to that shown and described above (but in single-body form). The electromechanical actuator 800 includes an encapsulated electromagnet assembly 804 and an encapsulated magnet assembly 806. The encapsulated electromagnet assembly 804 is housed in a portion of the housing 802 and translatable or moveable along guides 808, similar to that described above. The encapsulated magnet assembly 806 is housed within a track 810 defined by a portion of the housing 802. In operation, the encapsulated magnet assembly 806 may move along and within the track 810.

Similar to the described encapsulated electromagnet assemblies described above, the components of the magnet assembly of the electromechanical actuator 800 are encased within a material to protect such components and improve part life. As shown, the encapsulated magnet assembly 806 includes an encapsulating body 812 that houses a magnet 814, which may include a toothed block. The encapsulating body 812 also houses a connector pin 816 that is configured to engage with a connecting rod to enable actuation of a safety brake when the encapsulated magnet assembly 806 moves upward along the track 810. The formation and structure of the encapsulated magnet assembly 806 may be substantially similar to that of the encapsulated electromagnet assemblies described above. That is, similar materials and/or manufacturing processes may be employed to form the encapsulated magnet assembly 806.

The connector pin 816 may be part of a component integrator 818 that allows for different locations/arrangements of connection to a connecting rod. Depending on a specific application and arrangement of parts (e.g., of the safety brake) some safeties lend themselves to lifting from the top of a wedge (e.g., most symmetric safeties) and others lend themselves to lifting from a face of a wedge (e.g., most asymmetric safeties). The preformed structure of the component integrator 818 permits different connection points to the connector pin 816, and thus enables greater versatility as compared to prior configurations.

Figure 9A:
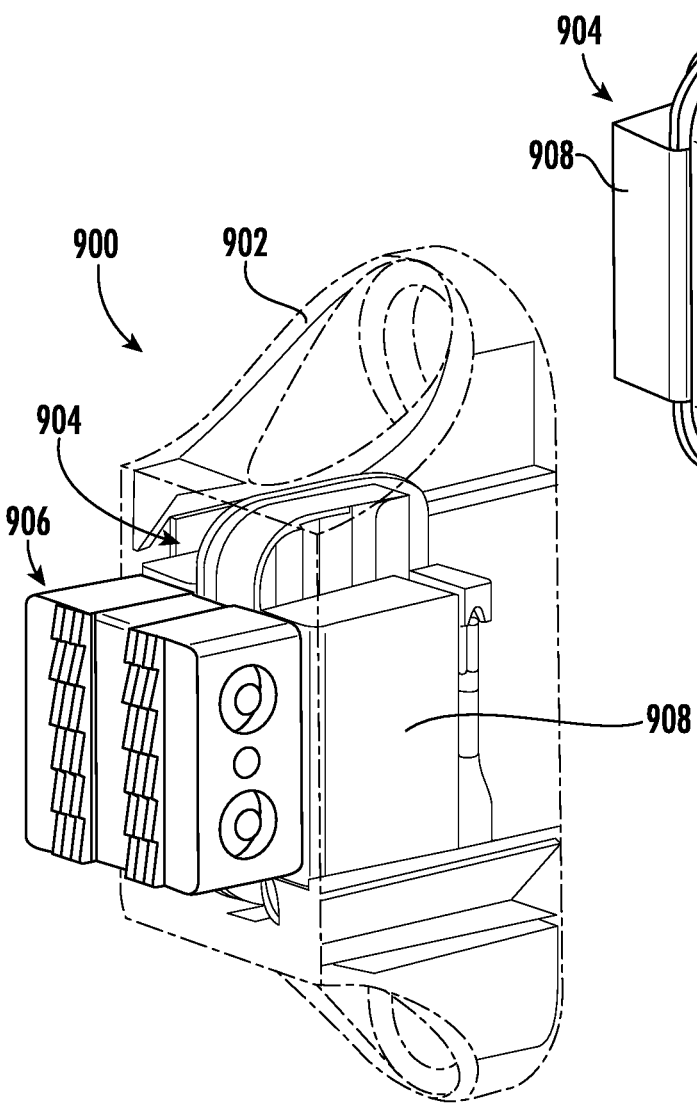
FIG. 9A is a schematic illustration of an electromagnet actuator in accordance with an embodiment of the present disclosure.
Figure 9B:
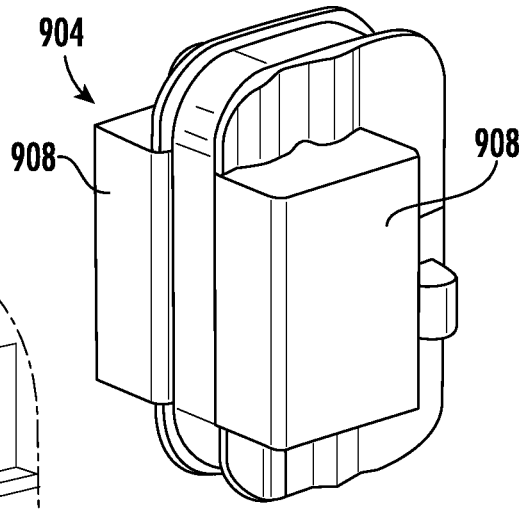
FIG. 9B is a schematic illustration of an electromagnet assembly of the electromagnet actuator of FIG. 9A.

Turning now to FIGS. 9A-9B, schematic illustrations of an electromagnet actuator 900 in accordance with an embodiment of the present disclosure is shown. The electromagnet actuator 900 includes encapsulated electromagnet assembly having an encapsulating body 902 that contains components of an electromagnet assembly 904 (shown in isolation in FIG. 9B). As shown, in FIG. 9A, the electromagnet assembly 904 within the encapsulating body 902 is configured to magnetically interact with a magnet assembly 906.

In this embodiment, a core 908 of the electromagnet assembly 904 is a ferrite core. The above described configurations illustrated a laminated steel design for the cores. However, this illustrative embodiment employs a ferrite core. Such ferrite cores can provide both cost and performance advantages over laminated cores. However, ferrite is a ceramic and is therefore brittle and conventionally cannot survive the repeated actuations necessary and required in electromagnet assemblies for elevators. Advantageously, embodiments of the present disclosure encapsulate the core 908 and thus the use of ferrite (e.g., brittle) cores is enabled. The encapsulating material protects the ferrite core 908 and reduces or eliminates the brittleness risks typically associated with use of ferrite cores in electromagnet assemblies.

Accordingly, in accordance with embodiments of the present disclosure, electromechanical systems may incorporate one or more encapsulated components, such as electromagnet assembly and/or magnet assemblies, as shown and described above. The encapsulation of the components enables improved part life.

Advantageously, embodiments of the present disclosure enable increased electromechanical actuator component product life as compared to prior configurations. Advantageously, thousands of actuations can to be performed without the occurrence of failures in the coil, lead wire connectors, or metal flanges (which are eliminated). The embedding of components within an encapsulating body removes various stresses and forces that are typically applied to the components throughout a product life. As such, these components may be able to last longer than prior configurations.

Advantageously, by encapsulating the electromagnet and/or magnet assemblies, such assemblies can survive the thousands of actuations that are experienced over the product life and can overcome various the failure modes related to non-encapsulated magnet assembly. For example, such encapsulation of the magnet assembly may eliminate the potential for cracking of the magnet itself and/or the shearing of rivets used to mount and assembly the magnet assembly. Further, advantageously, because the encapsulating housing of the magnet assembly may be based on a mold or similar preform structure, the specific dimensions, shapes, orientations, connections, etc., may be customized based on a particular application, and the illustrative design is not to be limiting but rather is merely for example and illustrative purposes.

The terminology used herein is for the purpose of describing particular embodiments only and is not intended to be limiting of the present disclosure. The term "about" is intended to include the degree of error associated with measurement of the particular quantity and/or manufacturing tolerances based upon the equipment available at the time of filing the application. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An encapsulated component of an electromechanical assembly for an elevator system, the encapsulated component comprising:

an encapsulating body defined by a preformed body, a cast body, a molded structure body, or a potted structure body, wherein the encapsulating body is formed from a non-magnetic material; and a component assembly arranged within the encapsulating body, wherein at least some parts of the component assembly are embedded and suspended to be fixedly retained within the non-magnetic material of the encapsulating body such that the at least some parts are encased within the non-magnetic material, wherein the encapsulating body comprises a main body, a first mounting extension extending from a first end of the main body, and a second mounting extension extending from a second end of the main body, wherein the first mounting extension comprises a first mounting aperture having a first biasing surface and the second mounting extension comprises a second mounting aperture having a second biasing surface;

a first guide and a first biasing element, the first guide passing through the first mounting aperture, the first biasing element received at the first biasing surface; and a second guide and a second biasing element, the second guide passing through the second mounting aperture of the second mounting extension, the second biasing element received at the second biasing surface;

the encapsulating body and the component assembly configured to translate along the first guide and second guide.

2. The encapsulated component of claim 1, wherein the component assembly is an electromagnet assembly comprising at least a core and a coil, wherein the core and the coil are embedded within the material of the encapsulating body.

3. The encapsulated component of claim 1, wherein the component assembly is a magnet assembly comprising a magnet embedded within the material of the encapsulating body.

4. The encapsulated component of claim 1, wherein the encapsulating body includes a shell defining a cavity, wherein the at least some parts of the component assembly are housed within the cavity.

5. The encapsulated component of claim 4, further comprising a material surrounding the at least some parts of the component assembly and filling the cavity.

6. The encapsulated component of claim 1, wherein the non-magnetic material is plastic.

7. The encapsulated component of claim 1, wherein the component assembly includes a ferrite core.

8. An electromechanical actuator of an elevator system comprising:

a housing assembly;

an electromagnet assembly installed within the housing assembly; and a magnet assembly installed within the housing assembly, wherein at least one of the electromagnet assembly and the magnet assembly is an encapsulated component, wherein the encapsulated component comprises:

an encapsulating body defined by a preformed body, a cast body, a molded structure body, or a potted structure body, wherein the encapsulating body is formed from a non-magnetic material; and a respective assembly of the electromagnet assembly or magnet assembly arranged within the encapsulating body, wherein at least some parts of the respective assembly are embedded and suspended to be fixedly retained within the non-magnetic material of the encapsulating body such that the at least some parts are encased within the non-magnetic material, wherein the encapsulating body comprises a main body, a first mounting extension extending from a first end of the main body, and a second mounting extension extending from a second end of the main body, wherein the first mounting extension comprises a first mounting aperture having a first biasing surface and the second mounting extension comprises a second mounting aperture having a second biasing surface;

a first guide and a first biasing element, the first guide passing through the first mounting aperture, the first biasing element received at the first biasing surface; and a second guide and a second biasing element, the second guide passing through the second mounting aperture, the second biasing element received at the second biasing surface;

the encapsulating body and the component assembly configured to translate along the guides.

9. The electromechanical actuator of claim 8, wherein the electromagnet assembly includes a ferrite core.

10. The electromechanical actuator of claim 8, wherein the magnet assembly comprises a permanent magnet and a toothed block.

11. The electromechanical actuator of claim 8, wherein the encapsulating body includes a shell defining a cavity, wherein the at least some parts of the component assembly are housed within the cavity.

12. The electromechanical actuator of claim 11, further comprising a material surrounding the at least some parts of the component assembly and filling the cavity.

13. The electromechanical actuator of claim 8, wherein the non-magnetic material is non-magnetic metal, nylon, polyester, or polycarbonates.

14. The electromechanical actuator of claim 8, wherein the encapsulating body is formed of plastic.

15. The electromechanical actuator of claim 8, further comprising:

a connecting rod; and a safety brake, wherein the magnet assembly is operably coupled to the safety brake by the connecting rod.

16. The electromechanical actuator of claim 8, wherein the housing assembly comprises a first housing configured to be attached to a portion of an elevator car and a second housing defining a track, with the magnet assembly configured to move along the track.

* * * * *